US008468925B2

(12) United States Patent
Howland

(10) Patent No.: US 8,468,925 B2
(45) Date of Patent: Jun. 25, 2013

(54) SUICIDE BOMBER BLAST THREAT MITIGATION SYSTEM

(75) Inventor: Charles A Howland, Temple, NH (US)

(73) Assignee: Warwick Mills Inc., New Ipswich, NH (US)

( * ) Notice: Subject to any disclaimer, the term of this patent is extended or adjusted under 35 U.S.C. 154(b) by 167 days.

(21) Appl. No.: 13/102,070

(22) Filed: May 6, 2011

(65) Prior Publication Data

US 2011/0271825 A1 Nov. 10, 2011

Related U.S. Application Data

(60) Provisional application No. 61/331,845, filed on May 6, 2010.

(51) Int. Cl.

| | |
|---|---|
| ***F41H 5/04*** | (2006.01) |
| ***F41H 5/08*** | (2006.01) |
| ***F42B 12/00*** | (2006.01) |
| ***F42B 14/06*** | (2006.01) |

(52) U.S. Cl.
USPC ..... 89/36.02; 89/904; 89/914

(58) Field of Classification Search
USPC ..... 89/1.11, 36.01, 36.02, 36.05; 102/501, 102/502; 86/50
See application file for complete search history.

(56) References Cited

U.S. PATENT DOCUMENTS

| | | | | |
|---|---|---|---|---|
| 4,905,569 | A * | 3/1990 | Seksaria et al. | 89/36.02 |
| 5,864,767 | A * | 1/1999 | Drumgoole et al. | 588/313 |
| 5,898,125 | A | 4/1999 | Mangolds et al. | |
| 5,988,036 | A | 11/1999 | Mangolds et al. | |
| 6,854,374 | B1 * | 2/2005 | Breazeale | 86/50 |
| 6,904,838 | B1 * | 6/2005 | Dindl | 89/1.1 |
| 7,458,306 | B2 * | 12/2008 | Singh et al. | 89/36.02 |
| 8,186,276 | B1 * | 5/2012 | Olden et al. | 102/504 |
| 2002/0053279 | A1 * | 5/2002 | Jung et al. | 89/36.01 |
| 2006/0213360 | A1 * | 9/2006 | Ravid et al. | 89/36.01 |
| 2007/0113486 | A1 | 5/2007 | Howland | |
| 2007/0180982 | A1 | 8/2007 | Dagher et al. | |
| 2008/0257137 | A1 * | 10/2008 | James | 86/50 |
| 2011/0303079 | A1 * | 12/2011 | Joynt | 89/36.02 |

OTHER PUBLICATIONS

PCT Search Report and Written Opinion for PCT Application No. PCT/US2011/035440, Feb. 27, 2012, 8 pages.

* cited by examiner

*Primary Examiner* — Bret Hayes
(74) *Attorney, Agent, or Firm* — Maine Cernota & Rardin

(57) ABSTRACT

A non-lethal, sabot-deployed blast shield mitigates a suicide bomber by wrapping around the bomber and positioning a plurality of protective layers over an explosive device to absorb emitted heat, shock waves, and projectiles if the device is detonated. Stand-offs such as inflatable beams or pillows provide break-away zones between the protective layers, allowing some layers to expand to a point of failure and absorb the maximum possible energy. Inner layers absorb shock waves and heat. One or more outer layers resist projectile penetration. Protective layers can be positioned on opposing sides of a suspect in case two explosive devices are present. Shields can deploy with sufficient energy to knock down a bomber. In embodiments, a plurality of shields can be applied without interference therebetween. In some embodiments, a round shield includes bolas which spread the shield in flight in a cast-net dynamic and wrap around the suspect for shield attachment.

22 Claims, 21 Drawing Sheets

SUICIDE BOMBER BLAST THREAT MITIGATION SYSTEM

RELATED APPLICATIONS

This application claims the benefit of U.S. Provisional Application No. 61/331,845, filed May 6, 2010, which is herein incorporated by reference in its entirety for all purposes.

FIELD OF THE INVENTION

This invention relates to anti-terrorist weapons, and more particularly to non-lethal weapons for disabling a suicide bomber and mitigating the effects of a suicide bomb blast.

BACKGROUND OF THE INVENTION

Suicide bombers present a unique threat to lives and property in the modern world. The willingness of a fanatic to wear explosives concealed about his or her person, and to detonate those explosives when hostages or other innocent persons are nearby, poses special problems for police, military, and other security and law enforcement personnel. Conventional weapons, both lethal and non-lethal, can be used to neutralize most types of suspected criminals or terrorists. However, once a suicide bomber has taken hostages, or has otherwise reached his or her target, disabling or killing the bomber will only precipitate detonation of the explosives carried by the bomber.

Typically, a suicide bomber will carry explosives such as TNT or C4 strapped to his or her body in a manner which is difficult to detect under clothing. This necessarily limits the amount of explosives which can be carried, both due to bulkiness and due to weight. One common tactic is to include a layer of "penetrating metal projectiles" or "PMP's" over a layer of explosives, so that the PMP's will act as shrapnel, and will be projected outward at high speed by the explosives, causing greater damage than would result from the heat and concussion of the blast alone. This combination of explosives and PMP's concealed under clothing is sometimes referred to as a "Person-Borne Improvised Explosive Device," or PB-IED.

FIG. 1 illustrates a simple PB-IED of this type, wherein a layer of ½ inch steel ball bearings has been attached using cardboard and duct tape to a layer of TNT packets. In this example, panels of TNT weighing a total of five pounds are covered by 10 pounds of ball bearings, resulting in a 30 pound PB-IED which will direct most of its destruction outward from the bomber. FIG. 2A shows a PB-IED similar to the one shown in FIG. 1 held against a man's torso, and FIG. 2B shows the PB-IED of FIG. 2A worn beneath a woman's blouse, where it is difficult to detect. In some instances, a suicide bomber may wear a second PB-IED on his or her back, thereby projecting destruction outward in virtually all directions. Of course, this doubles the weight which must be carried by the bomber.

Another dilemma faced by security and enforcement personnel is that the identity of a suicide bomber is sometimes not completely certain. The probability may be so high, and the danger so great, that officials have no choice but to act. And yet there is sometimes the possibility that an individual has been mistaken for a suicide bomber, and that an innocent person may be injured or killed in the mistaken belief that he or she is a terrorist. Normally, a suspect can be disabled without serious injury through use of a TASER or other non-lethal weapon. However, in the case of a suicide bomber such an approach is likely to cause immediate detonation of the bomber's explosives.

One approach which has been suggested is illustrated in FIG. 3. A projectable rectangular blast shield 300 is initially contained within a canister or "sabot 302," and is fired toward a suspect 304. A non-lethal "knock-down" projectile 306 is also packed within the sabot 302, and follows closely behind the shield 300. As shown in the figure, the shield 300 unpacks itself from the sabot 302 while in flight, and attempts to intercept PMP's from a blast while the projectile 306 knocks the suspect 304 down. Unfortunately, the deployment mechanism for this approach is highly complex, thereby increasing cost and reducing the likelihood of success. Also, the shield can only protect from PMP's projected in a single direction, and if multiple shields are fired at the suspect, they will tend to interfere with each other and may fail to work at all. In addition, it is unlikely that the simple shield 300 of FIG. 3 will be sufficient to protect bystanders from the heat, concussion, and PMP's of a typical PB-IED.

What is needed, therefore, is a weapon which will disable a suspected suicide bomber while mitigating injury and damage to bystanders due to detonation of a PB-IED carried by the suspected bomber, and while minimizing the risk of injury to the suspected bomber in case it turns out that the suspect is not actually a suicide bomber.

SUMMARY OF THE INVENTION

The present invention is a blast shield which can be initially contained within a canister or "sabot" and fired toward a suspected suicide bomber. Once fired, the blast shield emerges from the sabot, opens in mid-flight, and at least a portion of the blast shield is wrapped around the suspect while a plurality of protective layers are positioned in front of a PB-IED worn by the suicide bomber, thereby simultaneously disabling the suspect and mitigating blast damage if the PB-IED is detonated.

The protective layers include at least one inner layer and at least one outer layer, wherein the inner layers are configured primarily for absorbing heat and/or shock waves, while the outer layer or layers are configured to resist penetration by projectiles as well as by heat and shock waves.

The protective layers are spaced apart by stand-offs, which in some embodiments are inflatable air-beams or air pillows. This creates "breakaway zones" between the protective layers, and allows at least some of the layers to expand to a point of failure before subsequent layers are impacted, thereby ensuring maximum absorption of energy by each of the layers. In this manner, some of the layers protect subsequent layers through their own destruction. The stand-offs also allows the protective layers to move relative to each other as they are impacted by pressure waves, thereby improving their ability to withstand a blast.

In various embodiments, the inner layers absorb shock wave and heat energy over at least a 90 degree solid angle of projection from the PB-IED, while one or more outer layers provide ballistic penetration resistance over at least a 45 degree solid angle. Some embodiments position layers of shielding and stand-offs both in front and in back of a suspect, so as to provide protection in case the suspect is carrying two PB-IED's, one in front and one in back. Also, because the shield wraps around a suspect, in some embodiments multiple shields can be deployed from different directions without interference therebetween, so as to provide blast protection in virtually all directions.

In certain embodiments, at least some inner layers are made from para-aramid or LCP having a denier per filament of from 2 to 5 or more. In some embodiments, the inner layers are mesh wovens with Frazer permeability of at least 500 cfm/ft, and in some embodiments greater than 600 cfm/ft, having mesh yarns of at least 500 denier, and in some embodiments greater than 1500 or 3000 denier. In various embodiments, the outer layer or layers provide V50 penetration resistance of at least 500 fps for ½ inch steel ball bearings, and in some of these embodiments the V50 resistance is greater than 1000 fps.

In certain embodiments the shield is round, and includes a plurality of weights suspended by cords extending symmetrically from the perimeter of the shield. When fired, the sabot spins, and this rotation is transferred to the shield as it emerges from the sabot. The weights act as "slungshots" or "bolas," and serve to hold the shield open in a "cast-net" dynamic as it approaches a suspect. Upon impact, the bolas wrap around the suspect in a manner similar to a South American bolas thrown by a gaucho, thereby wrapping the shield around the suspect.

The present invention is a non-lethal, projectile-deployed blast shield for mitigation of dangers posed by a suicide bomber suspect. The blast shield includes an inner protective layer configured for absorption of heat and shockwave energy generated by detonation of a person-borne improvised explosive device (PB-IED) attached to the suicide bomber, the absorption of energy including expansion of the inner protective layer to a point of failure within a break-away zone, an outer protective layer configured for resistance to penetration by penetrating metal projectiles (PMP's) projected by the detonation of the PB-IED, and a stand-off located between the inner protective layer and an adjacent protective layer, the stand-off being deployable so as to create the break-away zone. The blast shield is configured for deployment from a sabot projectile after the sabot projectile has been projected toward the suicide bomber suspect, the deployment including wrapping of a portion of the blast shield around the suicide bomber suspect so as to position and maintain the protective layers in front of the PB-IED.

In various embodiments, the blast shield is configured to deliver sufficient energy to knock a large man from a standing to a prone orientation, but not sufficient energy to pose a significant risk of killing the suicide bomber suspect. In some of these embodiments the blast shield is configured to deliver between 2000 and 10,000 Joules of energy to the suicide bomber.

In certain embodiments the stand-off is one of an air beam and an air pillow. In some embodiments the inner protective layer absorbs shock wave and heat energy over at least a 90 degree solid angle of projection from the PB-IED, and the outer protective layer provides resistance to penetration by PMP's over at least a 45 degree solid angle of projection from the PB-IED.

In other embodiments the blast shield includes inner and outer protective layers and stand-offs which are distributed between two layer groups, the layer groups being configured for deployment on opposing sides of the suicide bomber suspect.

In various embodiments a plurality of blast shields can be deployed from different directions without substantial interference therebetween.

In some embodiments the inner layer is made from at least one of para-aramid and LCP. In other embodiments the inner layer is made from a fiber having a denier per filament of at least two.

In certain embodiments the inner layer is made of a mesh woven. In some of these embodiments the mesh woven has a Frazer permeability of at least 500 cfm/ft. In other of these embodiments the mesh woven has a Frazer permeability of at least 600 cfm/ft. In still other of these embodiments the mesh woven includes a mesh yarn of at least 500 denier. In yet other of these embodiments the mesh woven includes a mesh yarn of at least 1000 denier. In other of these embodiments the mesh woven includes a mesh yarn of at least 1500 denier. And in yet other of these embodiments the mesh woven includes Vectran, where "Vectran" is a trademark of Kuraray Co., Ltd., Hoechst Celanese Corporation, and is used herein to refer generically to a manufactured fiber spun from a liquid crystal polymer.

In various embodiments the inner layer is made from a material which is self extinguishing, and does not support flame. In some embodiments the blast shield provides V50 penetration resistance of at least 500 fps for ½ inch steel ball bearings. In other embodiments the blast shield provides V50 penetration resistance of at least 1000 fps for ½ inch steel ball bearings. And in yet other embodiments the outer layer includes HMWPE.

In certain embodiments the protective layers are at least approximately round in shape, the blast shield further includes a plurality of weights suspended from the blast shield by a plurality of cords attached symmetrically about an outer rim of the blast shield, and deployment of the blast shield includes rotation of the blast shield, thereby extending the weights outward by centrifugal force, and extending the shield into an approximately planar, cast-net dynamic whereby a direction of flight of the blast shield toward the suicide bomber suspect is substantially normal to the plane of the blast shield.

In various embodiments the blast shield includes three inner protective layers and one outer protective layer. And in certain embodiments the blast shield includes two inner protective layers and one outer protective layer.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
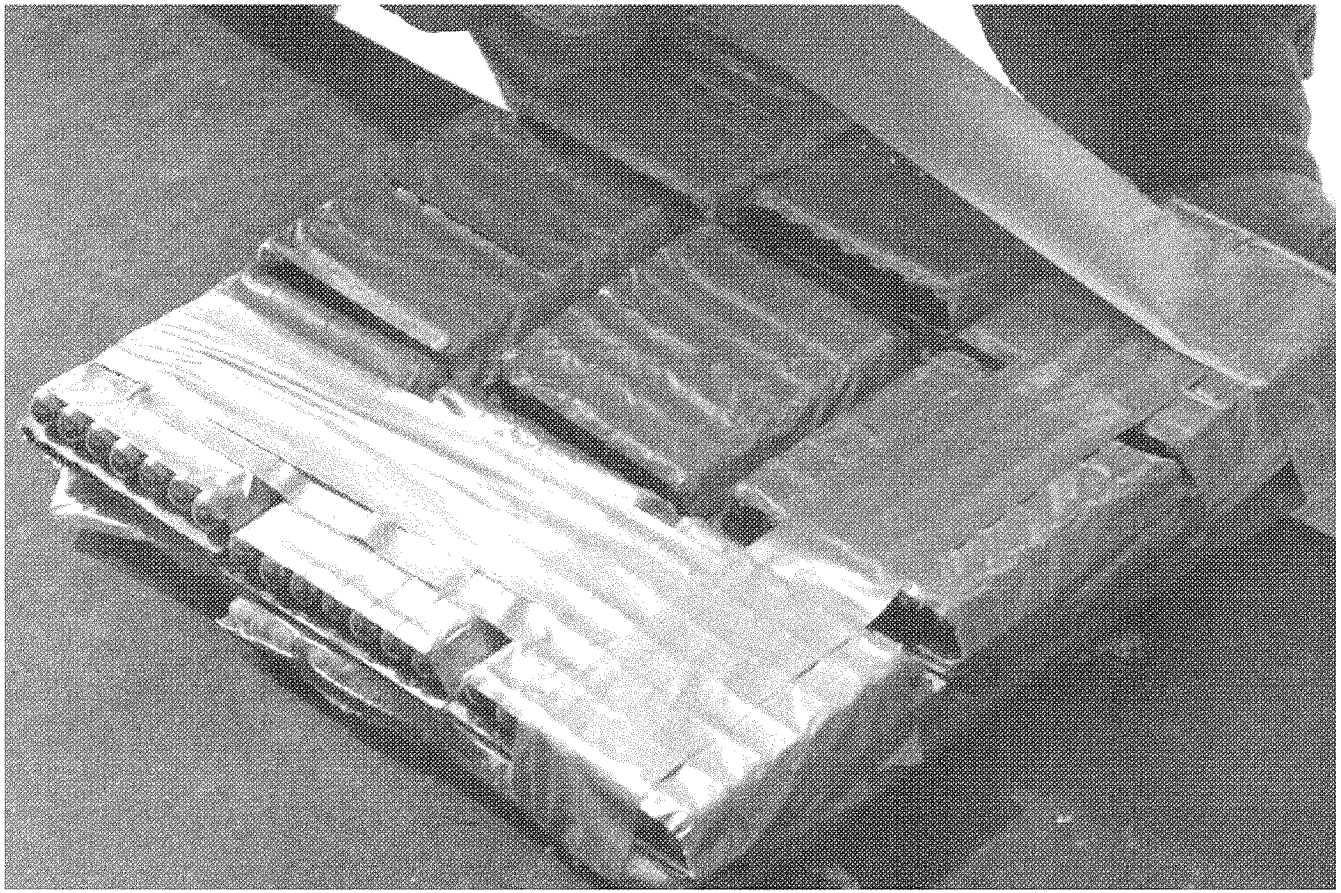
FIG. 1 is a picture of a PB-IED comprising a layer of TNT covered by a layer of ½ inch ball bearings.
Figure 2A:
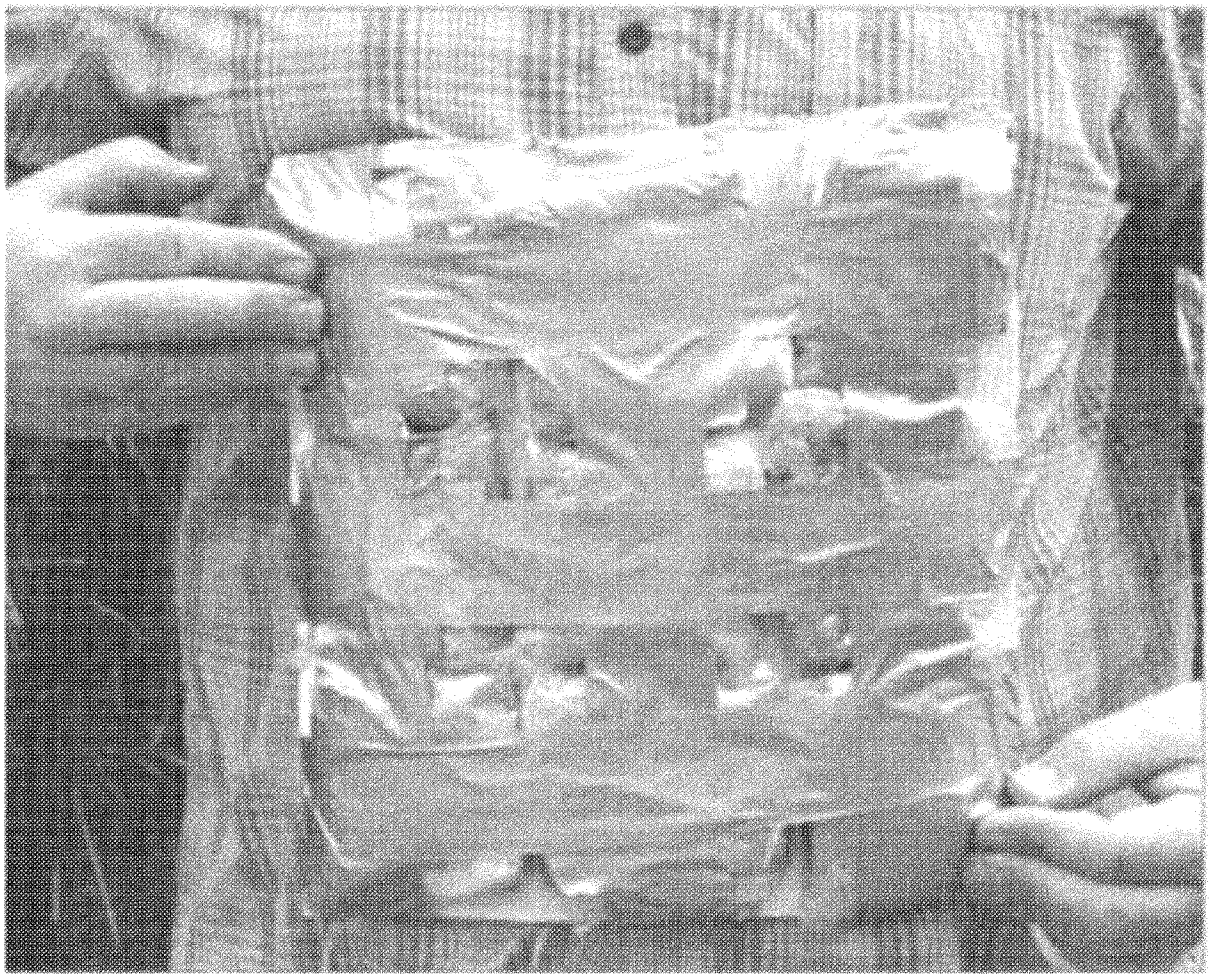
FIG. 2A is a picture of a PB-IED similar to the PB-IED shown in FIG. 1, held against the torso of a man.
Figure 2B:
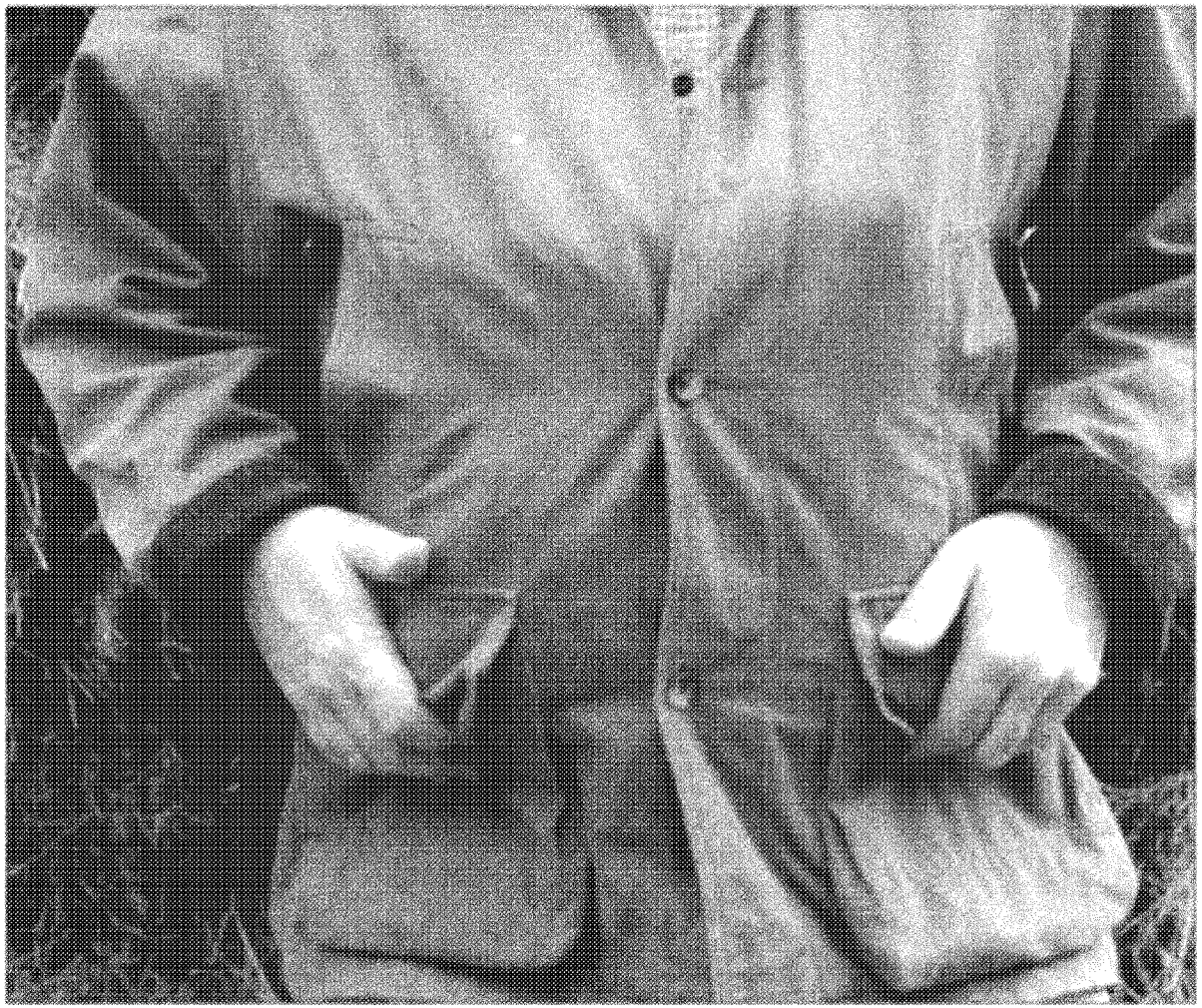
FIG. 2B is a picture of the PB-IED of FIG. 2A worn beneath the blouse of a woman.
Figure 3:
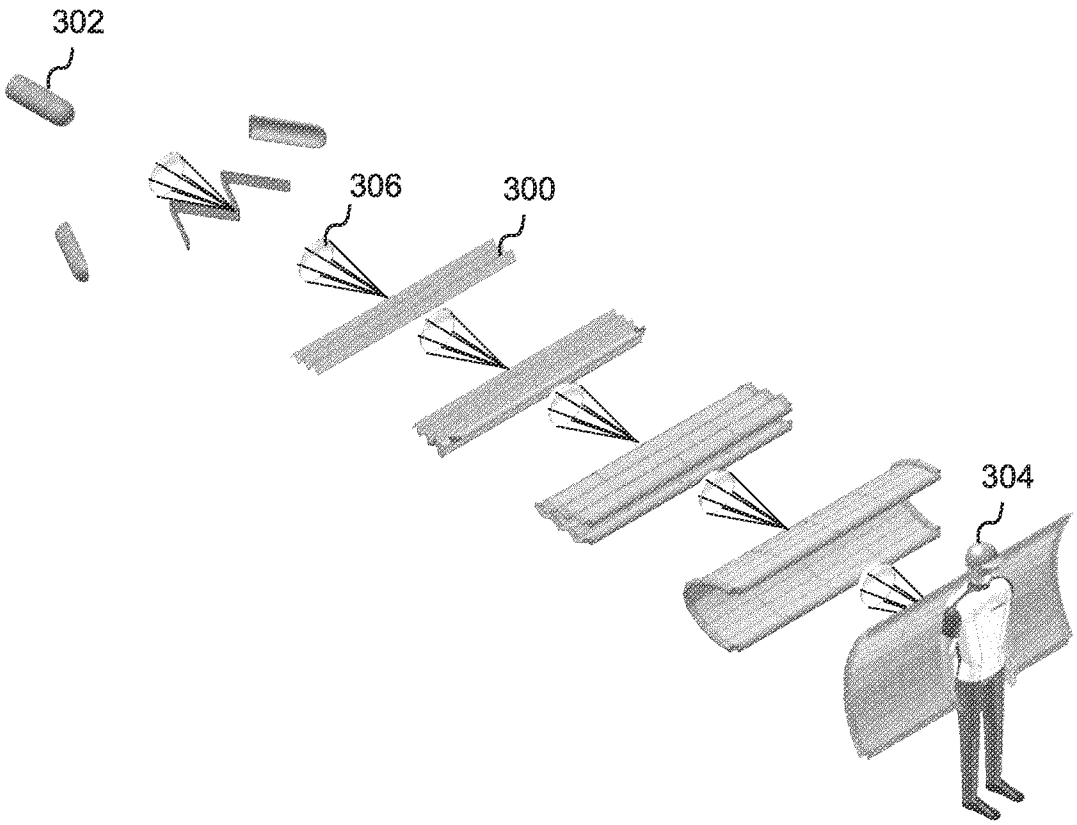
Figure 3 Prior Art
FIG. 3 illustrates deployment of a blast shield of the prior art.
Figure 4A:
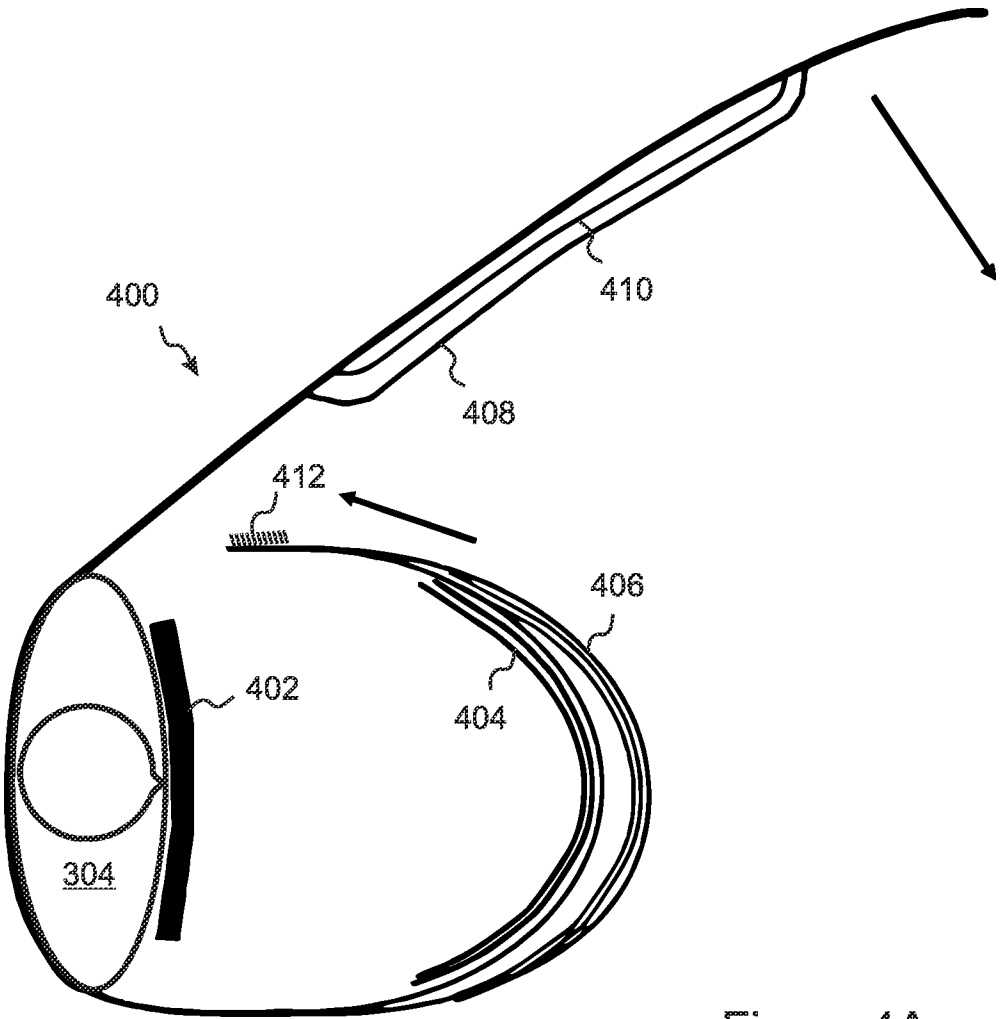
FIGS. 4A through 4C illustrate phases of deployment of an embodiment of the present invention.

With reference to FIG. 4A, the present invention is a blast shield 400 which can be initially contained within a canister or "sabot 302" and fired toward a suspected suicide bomber 304. Once fired, the blast shield 400 emerges from the sabot, opens in mid-flight, and at least a portion of the blast shield 400 is wrapped around the suspect 304 while a plurality of protective layers 404, 406, 408, 410 are positioned in front of a PB-IED 402 worn by the suicide bomber 304, thereby simultaneously disabling the suspect 304 and mitigating blast damage if the PB-IED 402 is detonated.

Figure 4B:
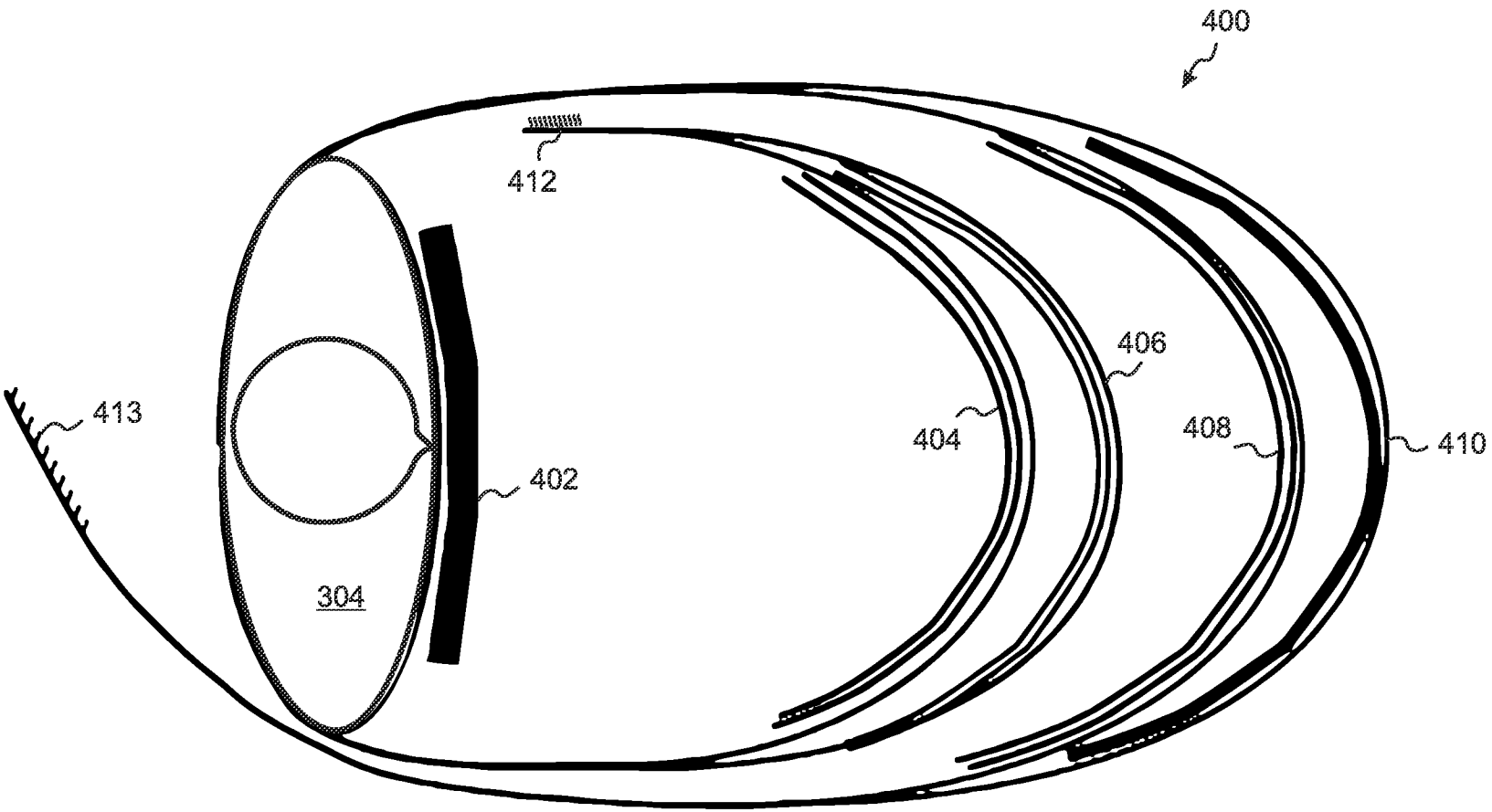

In the embodiment of FIGS. 4A and 4B, the blast shield 400 includes four protective layers 404, 406, 408, 410. Attachment mechanisms 412, 413 are provided at the ends of the shield 400, so that it will attach to itself and remain fastened to the suspect 304. In some embodiments, a weight is attached to the end of the shield that includes the inner two protective layers 404, 406, so that the center of mass of the shield 400 is off-center. When the center of mass of the shield strikes the back of the suspect 304, this causes the shorter end which carries the first two protective layers 404, 406 to wrap around the suspect 304 more quickly than the longer end. The four protective layers 404, 406, 408, 410 are thereby positioned in front of the PB-IED 402, as shown in FIG. 4B.

Figure 4C:
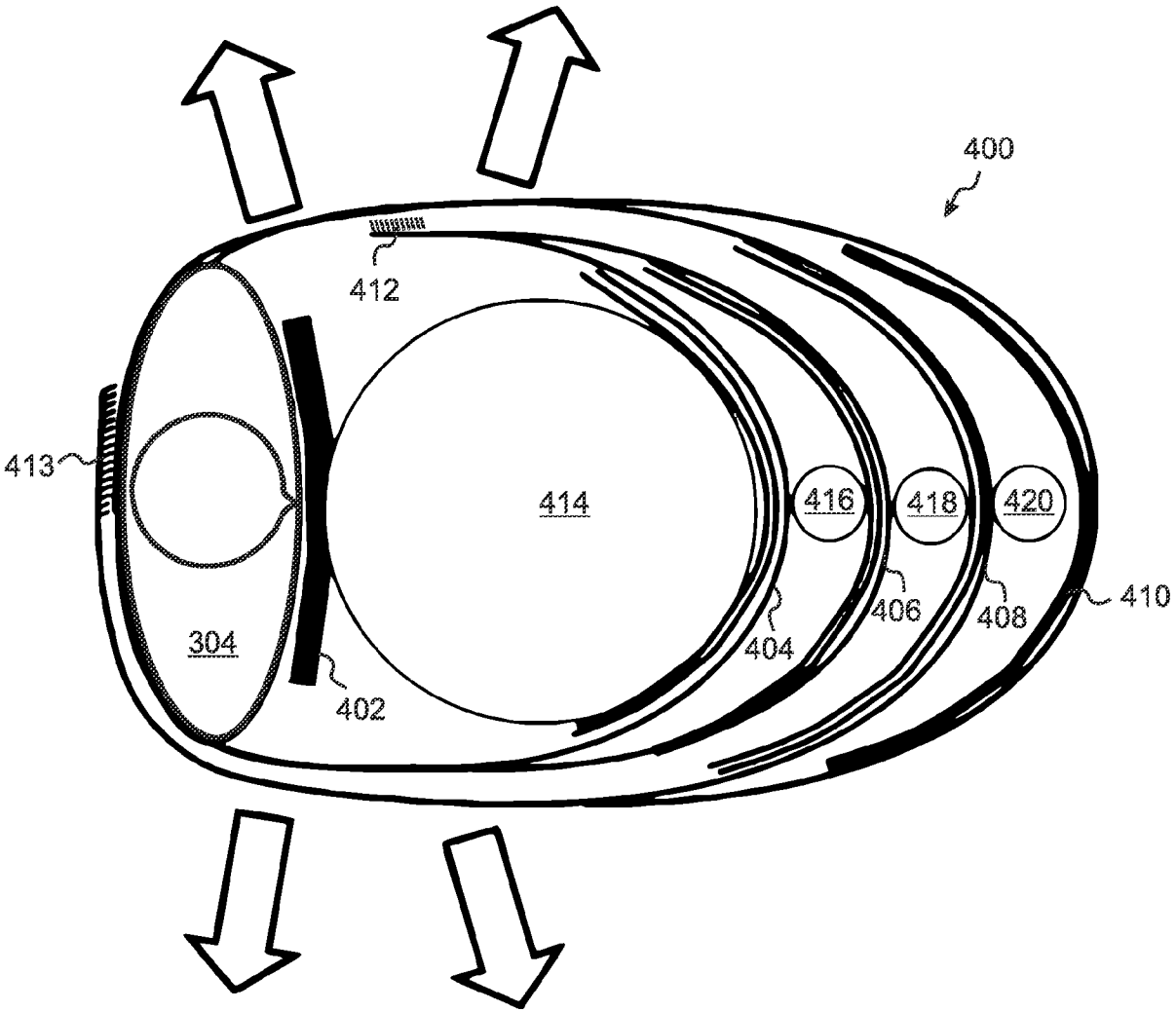

With reference to FIG. 4C, the protective layers 404, 406, 408, 410 are spaced apart by stand-offs 414, 416, 418, 420, which in the embodiment of FIG. 4C are inflatable air-beams. This allows layers 404, 406, 408 to expand to a point of failure within "breakaway zones" provided by the stand-offs 414, 416, 418, 420 before subsequent layers are impacted, thereby ensuring maximum absorption of energy by each of the layers 404, 406, 408. In this manner, at least some layers 404, 406, 408 protect subsequent layers through their own destruction. The stand-offs 414, 416, 418, 420 also allows the protective layers 404, 406, 408, 410 to move relative to each other as they are impacted by pressure waves, thereby improving their ability to withstand a blast.

Figure 5:
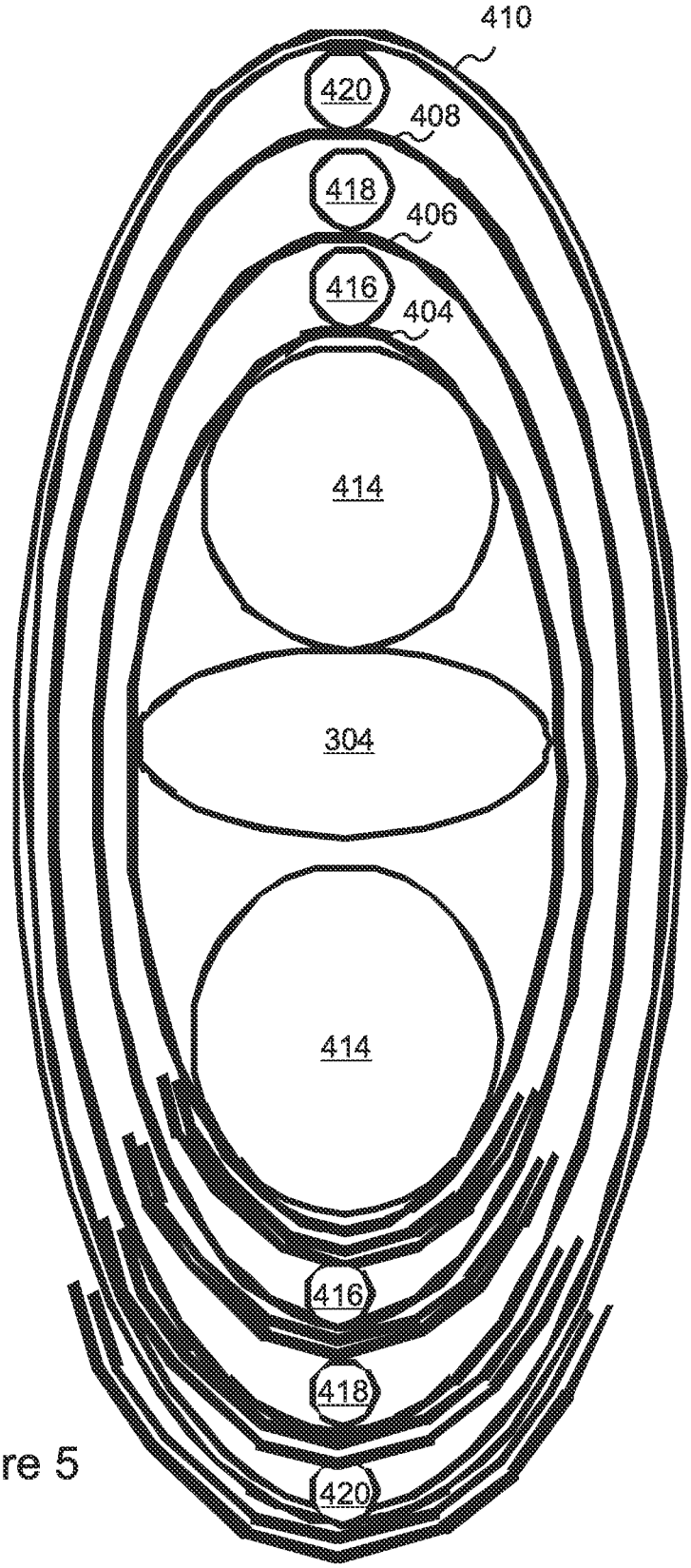
FIG. 5 illustrates deployment of an embodiment which provides protection against a suicide bomber wearing PB-IED's both in front and in back.

With reference to FIG. 5, some embodiments position protective layers 404, 406, 408, 410 and stand-offs 414, 416, 418, 420 both in front of and in back of a suspect 304, so as to provide protection in case the suspect 304 is carrying two PB-IED's 402, one in front and one in back.

In various embodiments, the inner layers absorb shock wave and heat energy over at least a 90 degree angle of projection from the PB-IED, while one or more outer layers provide high ballistic penetration resistance over at least a 45 degree angle. For example, in the embodiment of FIG. 4C, the two inner protective layers 404, 406 are made of a permeable mesh which has a tensile strength of at least 1000 lb/inch. In various embodiments, the tensile strength to mass ratio is as high as possible based on available fiber types. The fibers used for these layers are made from materials such as aromatic polymers and other glass and carbon based materials which have high thermal resistance, are self extinguishing, and do not support flame.

The outer two layers 408, 410 in the embodiment of FIG. 4C have ballistic penetration resistance, and include materials such as HMWPE. For example, in some embodiments which include three inner protective layers and one outer protective layer, the three inner protective layers are made of 6-ply Vectran mesh, and the outer layer includes 1 layer of Vectran plus at least one layer of UHMWPE panels.

Figure 6A:
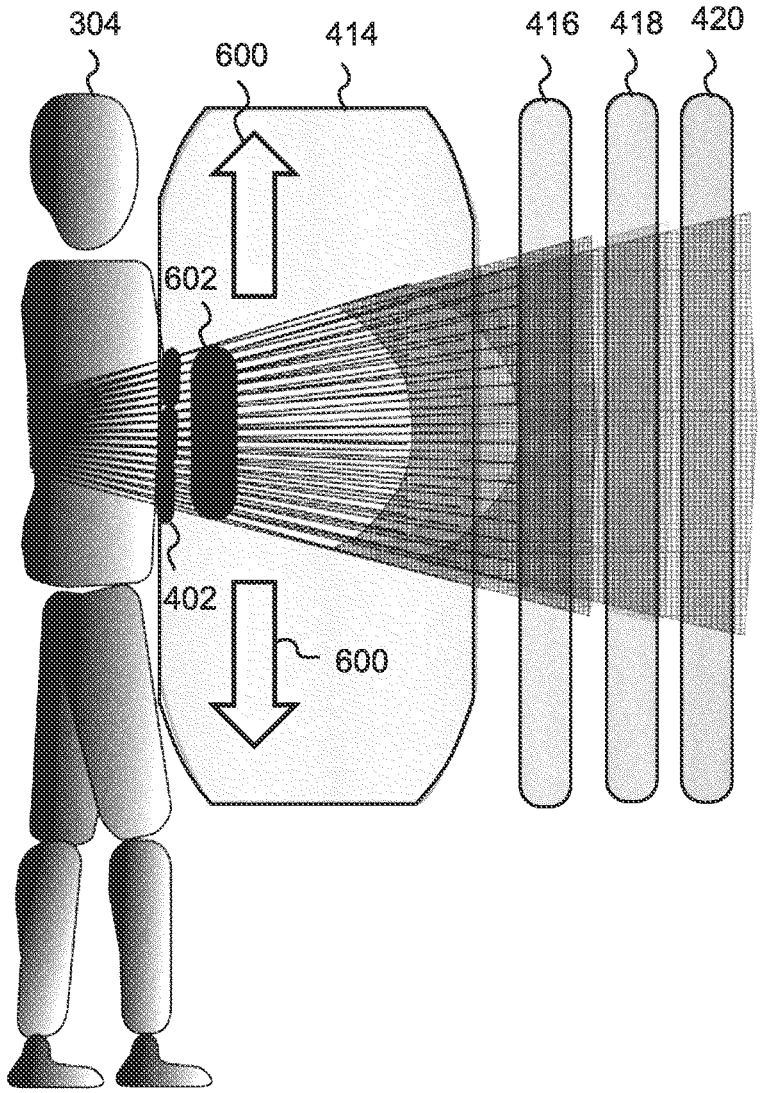
FIG. 6A illustrates vertical dissipation of energy through a blast energy zone near a bomber while projectiles are intercepted in a forward direction by the protective layers of the shield.

The zones on each side of the PB-IED 402 are made of cordage or webbing fabricated from high strength, high thermal resistance fiber, and present as little area to the shock wave and overpressure as possible. As illustrated in FIG. 6A, this allows much of the blast energy and shock wave 600 to be vertically and horizontally dissipated, while projected PMP's 602 are intercepted by the protective layers 404, 406, 408, 410.

In certain embodiments, at least some inner protective layers are made from para-aramid or LCP having a denier per filament of from 2 to 5 or more. In some embodiments, the inner layers are mesh wovens with Frazer permeability of at least 500 cfm/ft, and in some embodiments greater than 600 cfm/ft, having mesh yarns of at least 500 denier, and in some embodiments greater than 1500 or 3000 denier. In various embodiments, the outer layer or layers provide V50 penetration resistance of at least 500 fps for ½ inch steel ball bearings, and in some of these embodiments the V50 resistance is greater than 1000 fps.

Figure 6B:
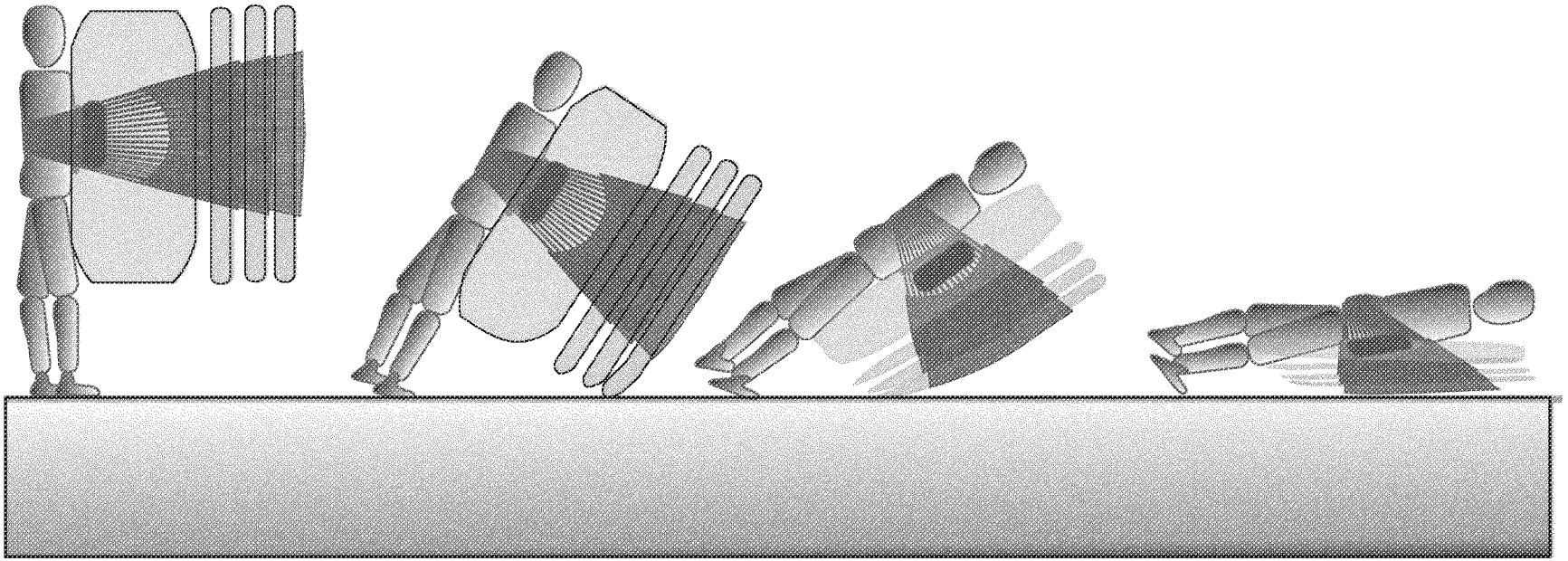
FIG. 6B illustrates knocking to the ground of a bomber by an embodiment of the present invention.

With reference to FIG. 6B, in various embodiments the blast shield strikes the suspect with sufficient force to knock a large male to the ground. In some embodiments, the energy delivered is at least 2000 Joules, and in certain embodiments it is as much as 10,000 Joules. However, the energy must not be sufficient to pose a significant threat of killing the suspect. Knocking the suspect to the ground provides further protection against detonation of a PB-IED, since the blast energy and PMP's are mainly directed into the ground.

Figure 7A:
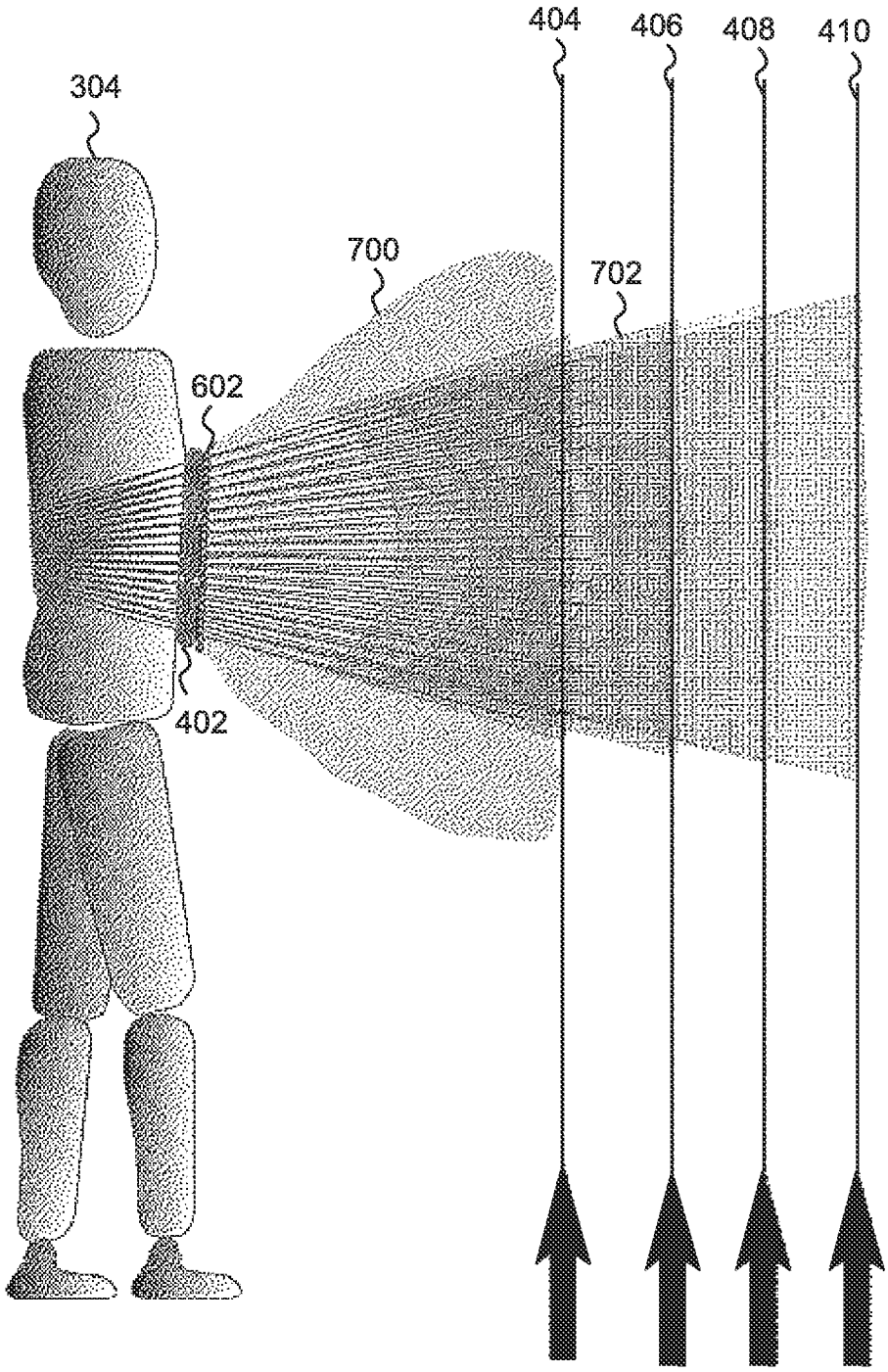
FIGS. 7A through 7E illustrate stages of blast absorption by an embodiment of the present invention.

The present invention is nevertheless able to contain the heat, shockwave, and PMP's of a typical PB-IED even if the suspect remains standing, or if the suspect is wearing a second PB-IED on his or her back. FIGS. 7A through 7E illustrate steps in the absorption of a blast in an embodiment of the invention. In FIG. 7A, the detonation of the explosive 402 has just begun. A blast of heat 700 has reached the first protective layer 404, and a shock wave 702 is propagating through the protective layers 404, 406, 408, 410 and is attenuated by each of them as it passes through until the shock wave is completely blocked by the final protective layer 410.

Figure 7B:
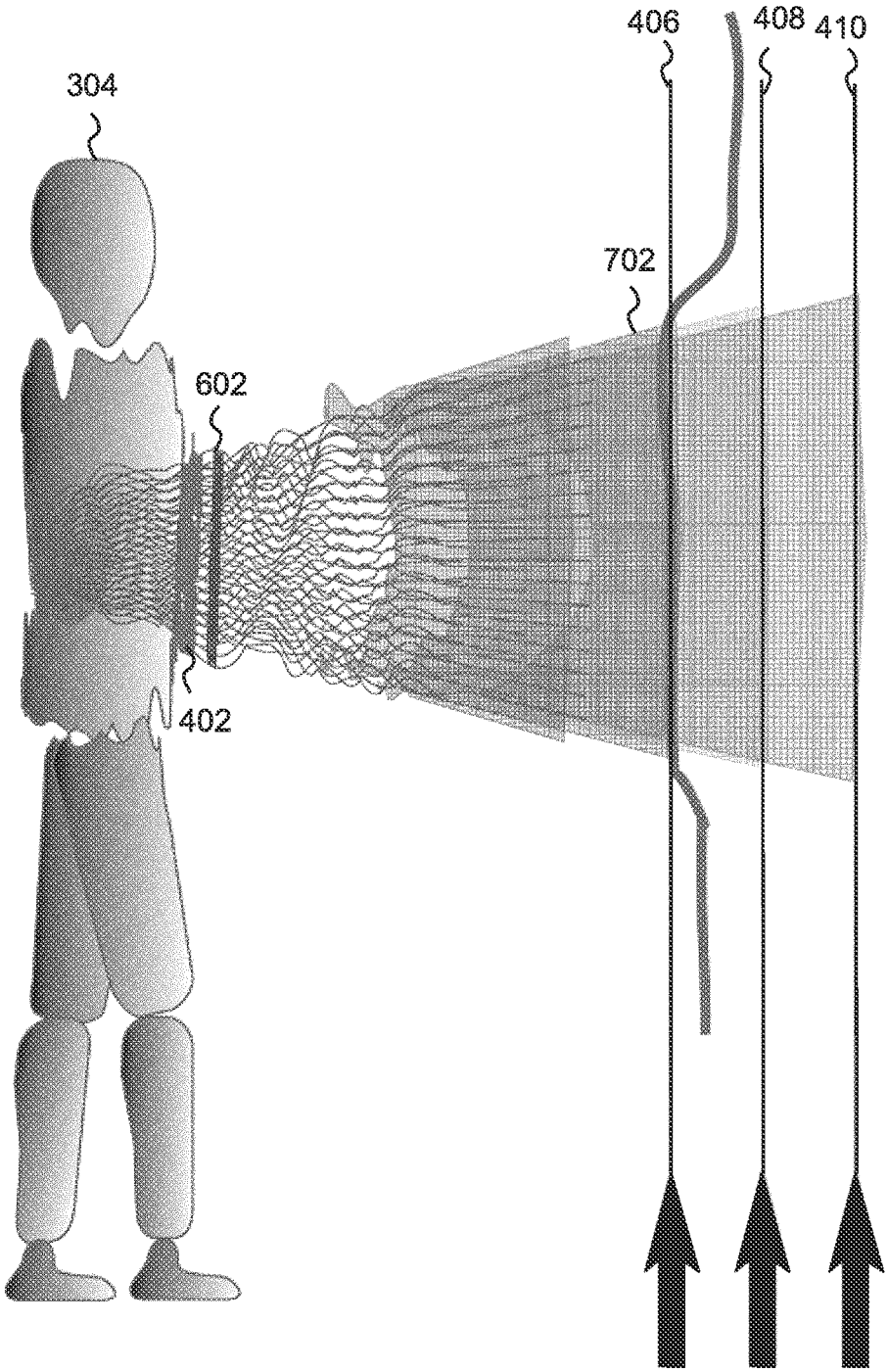

In FIG. 7B, the explosive 402 continues to detonate, and the PMP's 602 begin flying outward from the PB-IED. The first protective layer 404 has been damaged by the heat wave 700, and then physically destroyed by the shock wave 702. The other three protective layers 406, 408, 410 continue to absorb the shock wave 702.

Figure 7C:
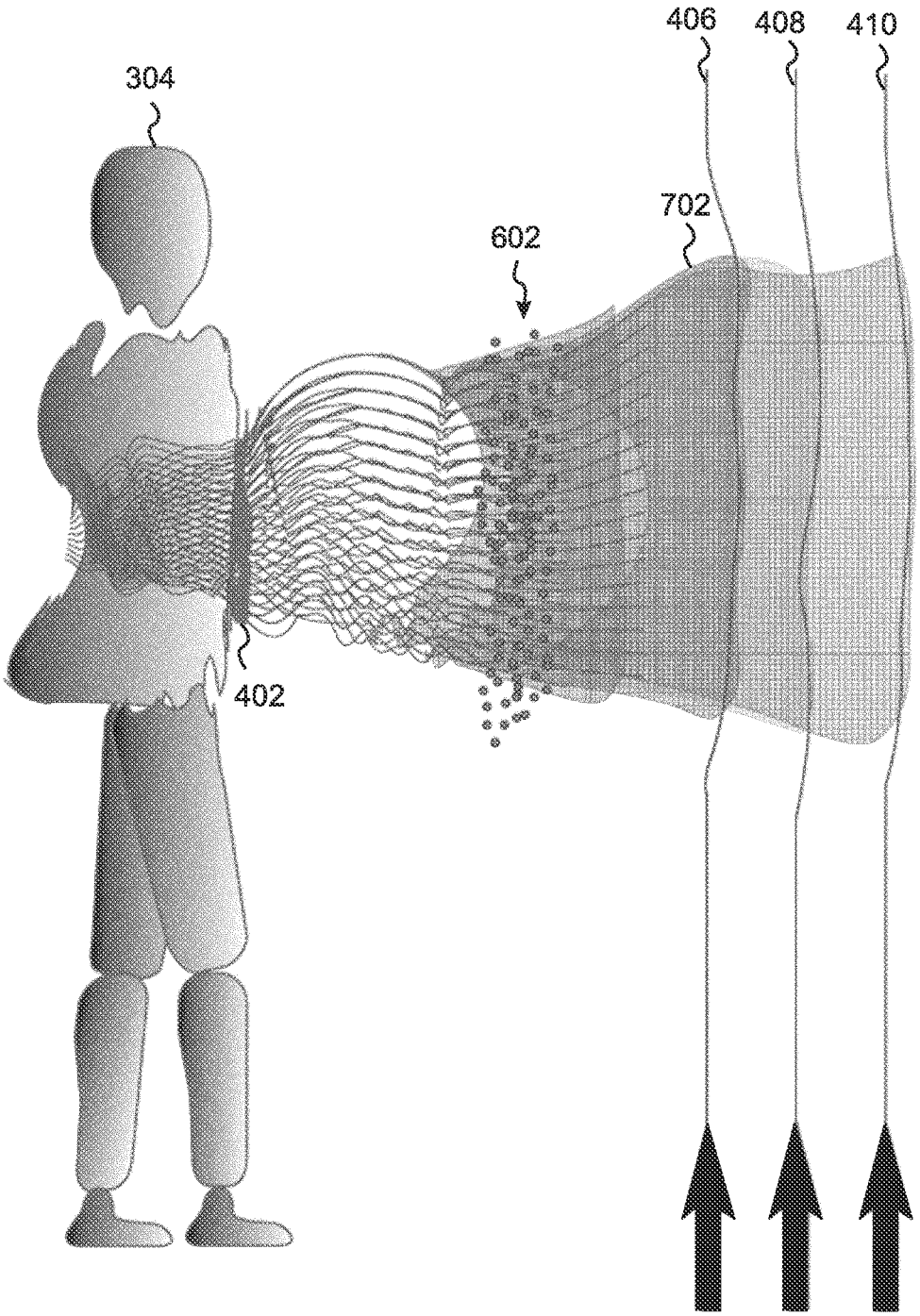

In FIG. 7C, the explosive 402 continues to detonate, and the PMP's are rapidly approaching the second protective layer 406 at a velocity of approximately 1000 to 1400 fps. The three remaining protective layers 406, 408, 410 flex in response to the shock wave 702.

Figure 7D:
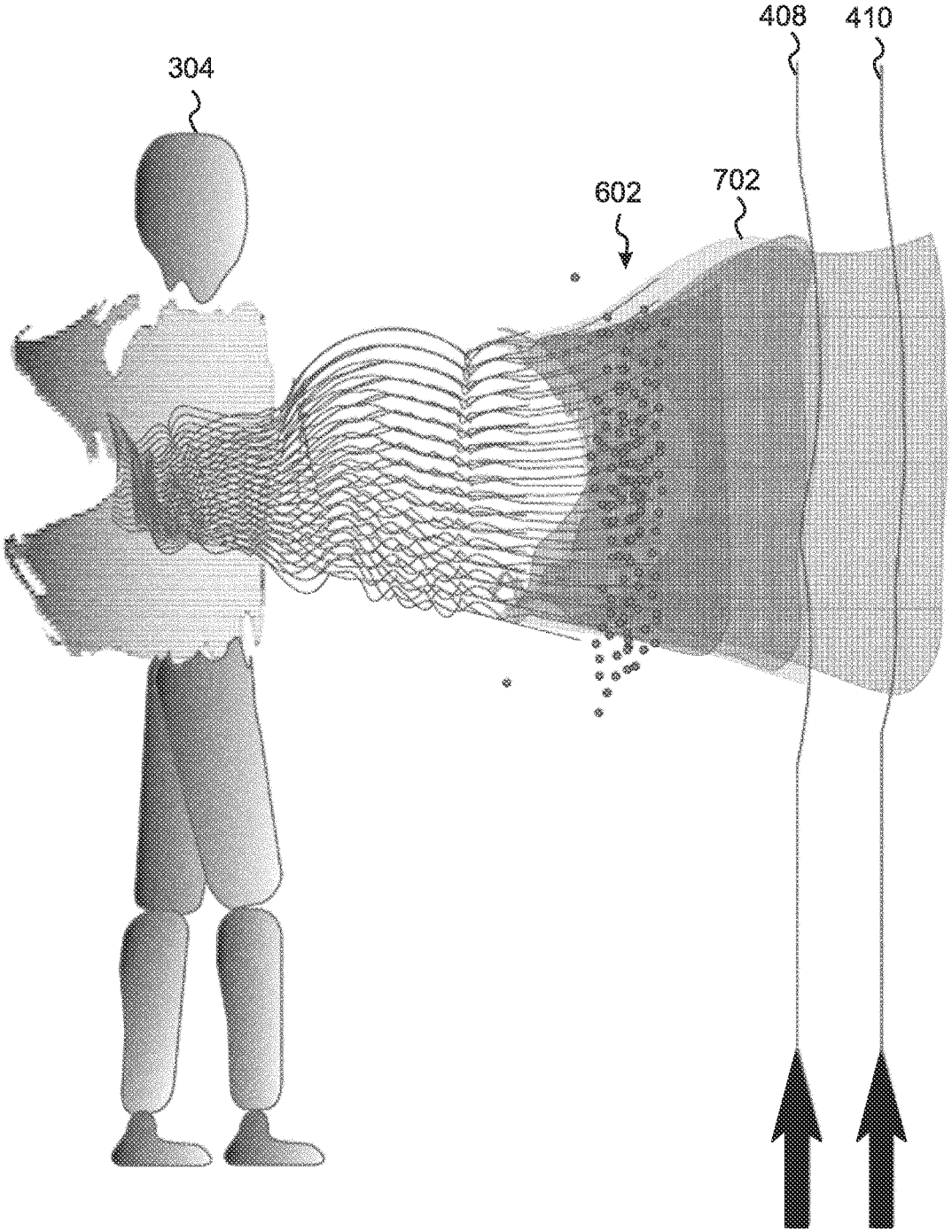

In FIG. 7D, the explosive 402 has been completely expended. The second protective layer 406 has been deformed to its maximum extent and has failed, having absorbed the maximum possible energy in doing so, while the third and fourth protective layers 408, 410 continue to absorb the shock wave.

Figure 7E:
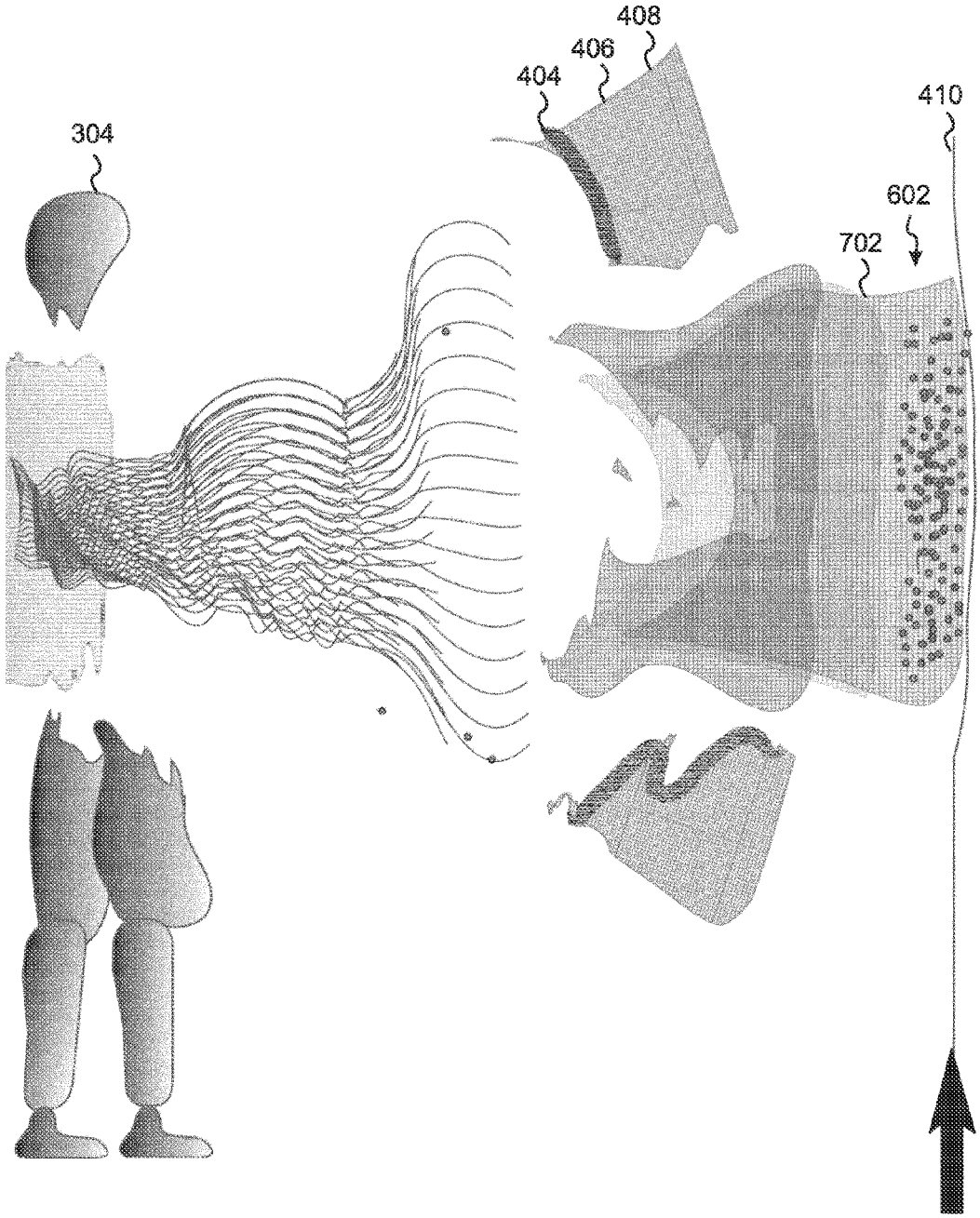

Finally, in FIG. 7E, the third protective layer 408 has been deformed to its maximum extent and has failed, and the PMP's 602 have reached the fourth protective layer 410. The fourth protective layer 410 is knocked back and away from the suspect, but is not penetrated by the PMP's 602 and continues to absorb the shock wave 702. The other, failed layers 404, 406, 408 are blown outward and away from the suspect.

Figure 8B:
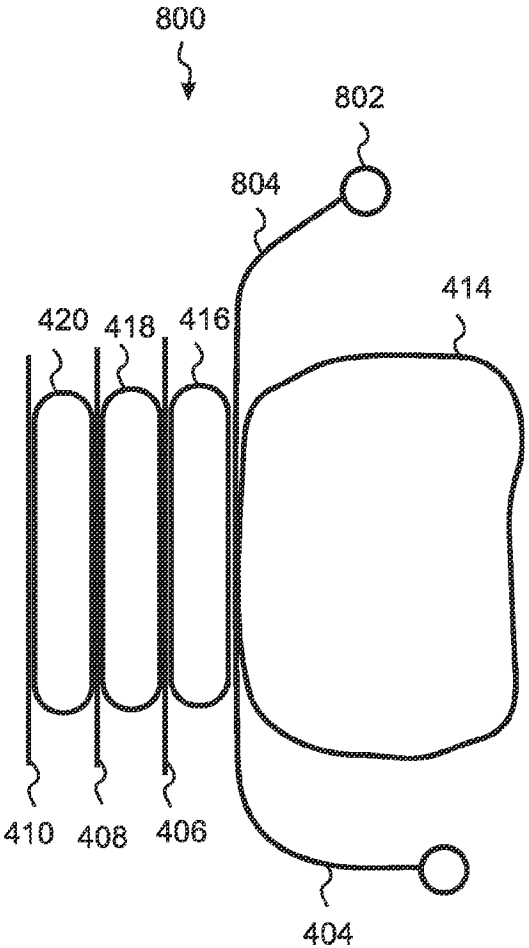
FIGS. 8A and 8B are front and side view respectively of a round embodiment of the present invention.
Figure 8A:
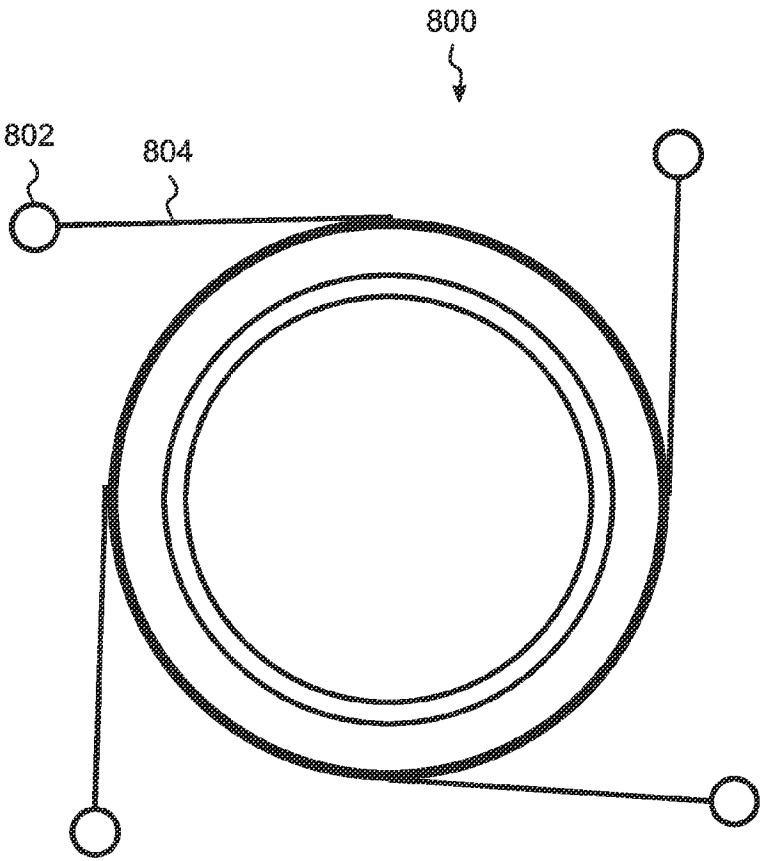

With reference to FIGS. 8A and 8B, in certain embodiments the shield 800 is round, and includes a plurality of weights 802 suspended by cords 804 extending symmetrically from the perimeter of the shield 800. When fired, the sabot 306 is made to spin, and this rotation is transferred to the shield 800 as it emerges from the sabot 306. The weights 802 act as "slungshots" or "bolas," and serve to deploy and hold the shield 800 open in a "cast-net" dynamic as it approaches a suspect 304. Upon impact, the bolas 802, 804 wrap around the suspect in a manner similar to a South American bolas thrown by a gaucho, thereby fastening the protective layers to the suspect 304. In the embodiment of FIGS. 8A and 8B, the shield 800 includes four protective layers 404, 406, 408, 410, whereby the outer two layers 408, 410 are smaller in diameter than the second layer 406, and the innermost layer 404 is the largest of all. When deployed, the protective layers 404, 406, 408, 410 are separated by stand-offs, which in the embodiment of FIGS. 8A and 8B are air beams or air pillows 414, 416, 418, 420.

Figure 9A:
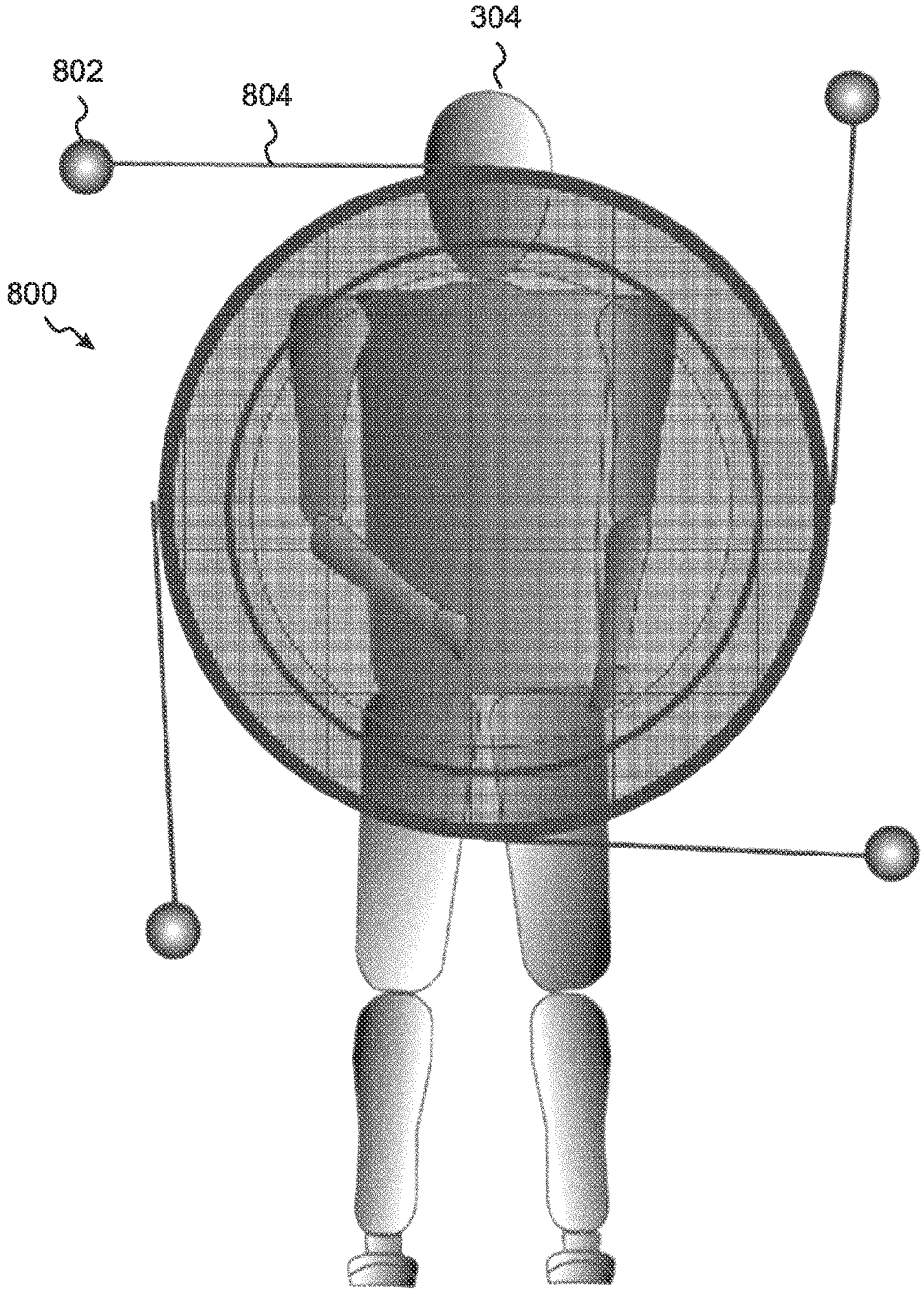
FIG. 9A illustrates the embodiment of FIG. 8A approaching a suspect from the front.
Figures 9B, 9C, 9D:
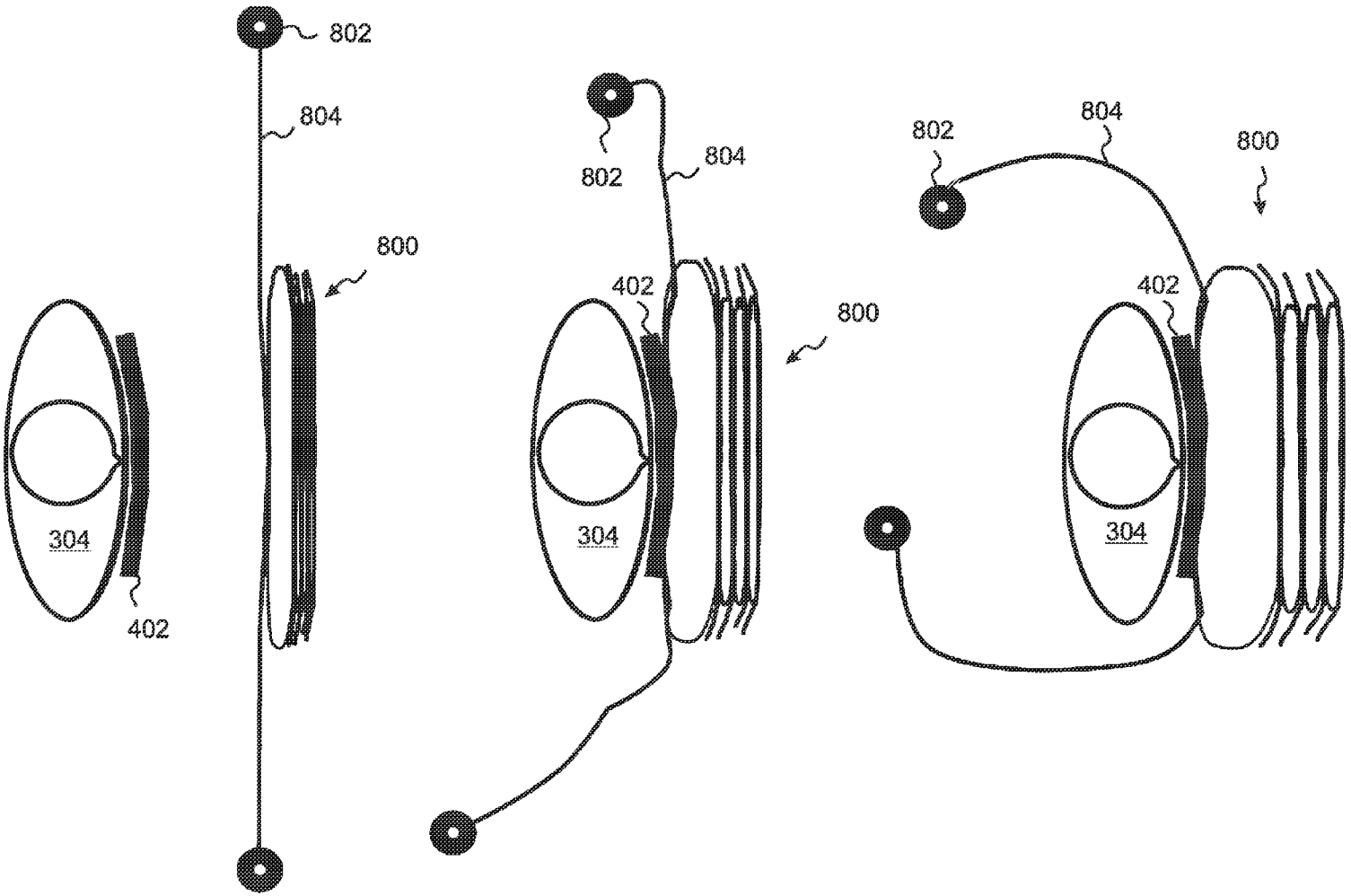
FIGS. 9B through 9E illustrate stages of deployment of the embodiment of FIG. 8A upon impact with the suspect.

FIGS. 9A through 9D illustrate stages in the deployment of the blast shield embodiment of FIGS. 8A and 8B. In FIGS. 9A and 9B, the shield has been ejected from the sabot 306, deployed by the bolas 802, 804, and is rotating in a "cast-net" dynamic as it approaches a suspect 304. In FIGS. 9C and 9D the shield 800 has impacted the front of the suspect 304, the air pillows 414, 416, 418, 420 are beginning to deploy, and the bolas 802, 804 are wrapping around the suspect 302.

Figure 9E:
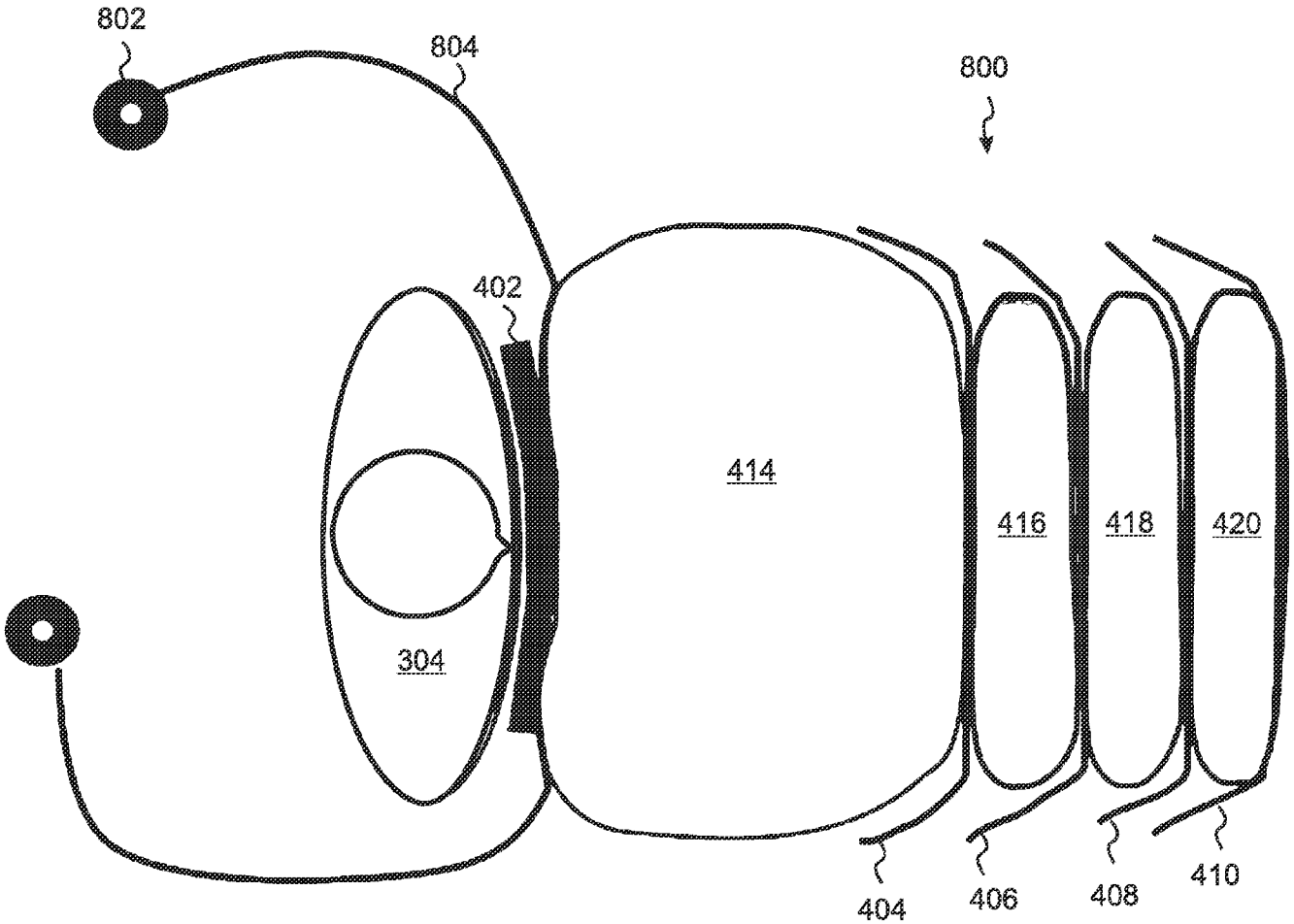

In FIG. 9E, the air pillows 414, 416, 418, 420 are fully inflated, and the bolas 802, 804 are continuing to wrap around the suspect 304. In the embodiment of FIGS. 9A through 9E, it is not necessary for any of the protective layers 404, 406, 408, 410 to wrap around the suspect 304, since the weights 802 and cords 804 of the bolas wrap around the suspect 304 and hold the protective layers 404, 406, 408, 410 against the PB-IED 402.

Figure 10A:
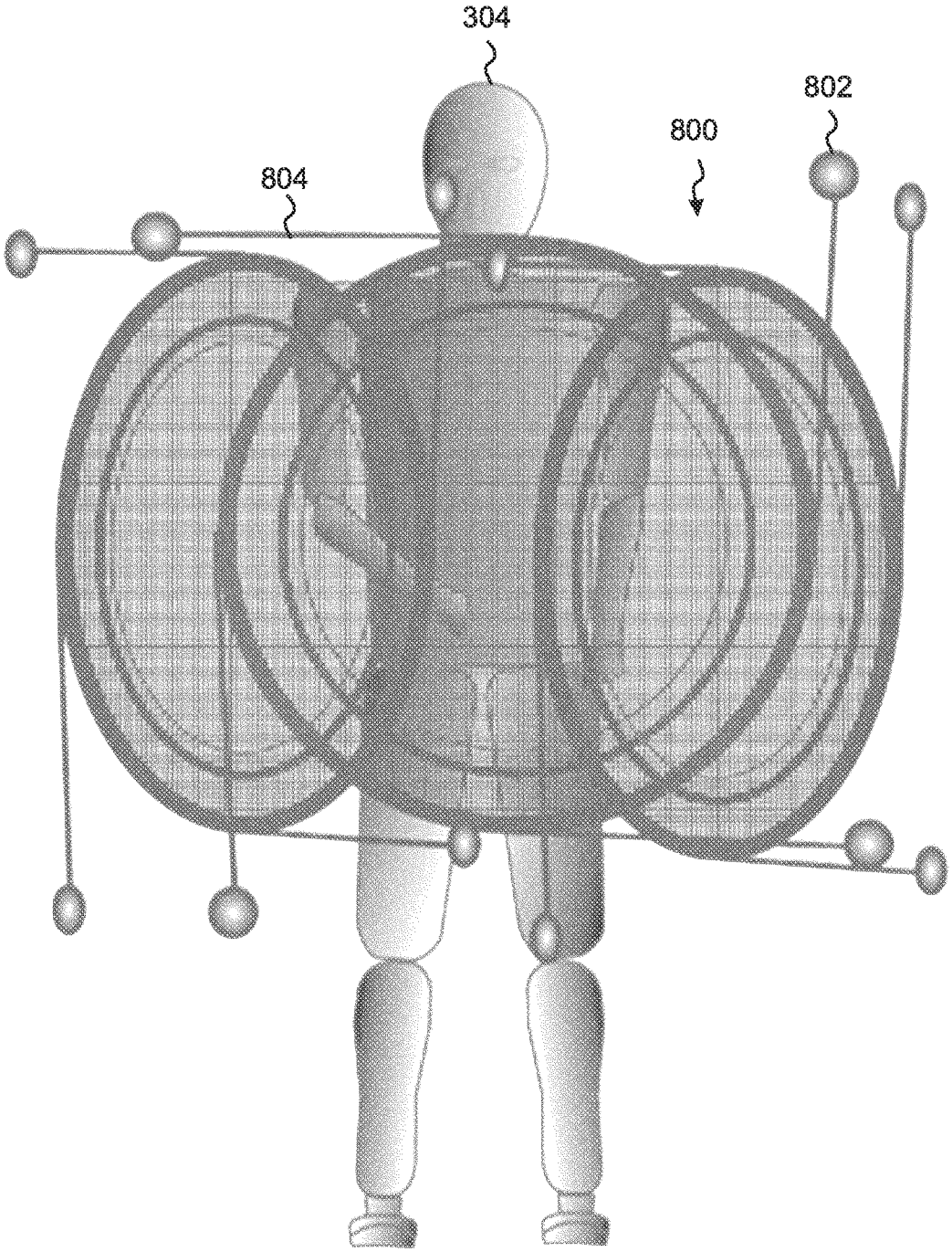
FIG. 10A illustrates three shields of the embodiment of FIG. 9A striking a suspect from different directions.
Figure 10C:
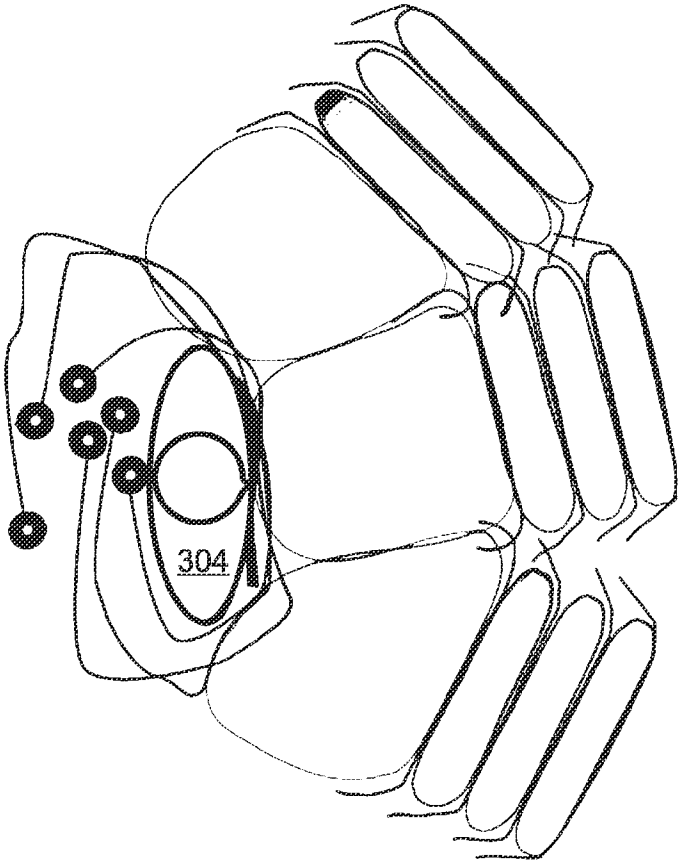
FIGS. 10B and 10C illustrate deployment of the three shields of FIG. 10A.
Figure 10B:
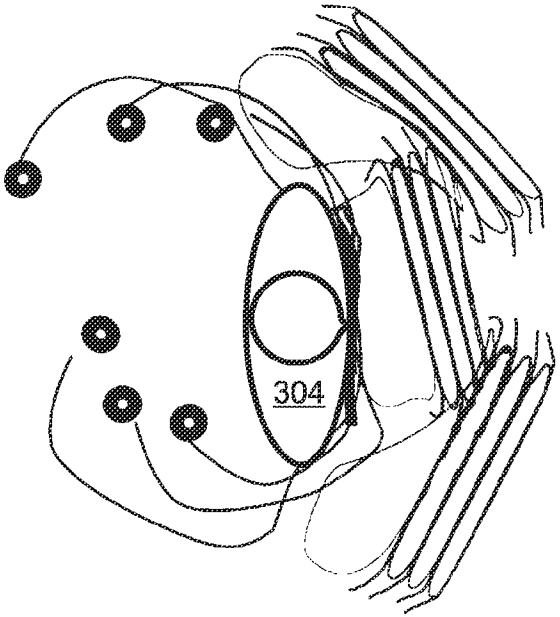

In various embodiment, the shield of the present invention conforms itself to the body of a suspect 304 and extends away from the suspect 304 only in a certain direction. This enables a plurality of shields to be deployed from different directions without interference therebetween, so as to provide blast protection in virtually all directions. This is illustrated in FIGS. 10A through 10C for the embodiment of FIG. 8. In FIG. 10A, three round shields 800 are seen approaching a suspect 304 from different directions. In FIG. 10B, the shields 800 have impacted the suspect 304, and are beginning to deploy, and in FIG. 10C the three shields 800 are fully deployed while the bolas 802, 804 are nearly wrapped around the suspect 304.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A non-lethal, projectile-deployed blast shield for mitigation of dangers posed by a suicide bomber suspect, the blast shield comprising:

an inner protective layer configured for absorption of heat and shockwave energy generated by detonation of a person-borne improvised explosive device (PB-IED) attached to the suicide bomber, the absorption of energy including expansion of the inner protective layer to a point of failure within a break-away zone;

an outer protective layer configured for resistance to penetration by penetrating metal projectiles (PMP's) projected by the detonation of the PB-IED; and a stand-off located between the inner protective layer and an adjacent protective layer, the stand-off being deployable so as to create the break-away zone;

the blast shield being configured for deployment from a sabot projectile after the sabot projectile has been projected toward the suicide bomber suspect, the deployment including wrapping of a portion of the blast shield around the suicide bomber suspect so as to position and maintain the protective layers in front of the PB-IED.

2. The blast shield of claim 1, wherein the blast shield is configured to deliver between 2000 and 10,000 Joules of energy to the suicide bomber.

3. The blast shield of claim 1, wherein the stand-off is one of an air beam and an air pillow.

4. The blast shield of claim 1, wherein the inner protective layer absorbs shock wave and heat energy over at least a 90 degree solid angle of projection from the PB-IED, and the outer protective layer provides resistance to penetration by PMP's over at least a 45 degree solid angle of projection from the PB-IED, a solid angle of projection from the PB-IED of X degrees being defined as the interior of a half cone extending from a vertex located at the PB-IED, said half cone being formed by rotating an angle of X degrees about its bisector.

5. The blast shield of claim 1, wherein the blast shield includes inner and outer protective layers and stand-offs which are distributed between two layer groups, the layer groups being configured for deployment on opposing sides of the suicide bomber suspect.

6. The blast shield of claim 1, wherein a plurality of blast shields can be deployed from different directions without substantial interference therebetween.

7. The blast shield of claim 1, wherein the inner layer is made from at least one of para-aramid and liquid crystal polymer.

8. The blast shield of claim 1, wherein the inner layer is made from a fiber having a denier per filament of at least two.

9. The blast shield of claim 1, wherein the inner layer is made of a mesh woven.

10. The blast shield of claim 9, wherein the mesh woven has a permeability of at least 500 cfm/ft, as measured by a Frazier air permeability tester.

11. The blast shield of claim 9, wherein the mesh woven has a permeability of at least 600 cfm/ft, as measured by a Frazier air permeability tester.

12. The blast shield of claim 9, wherein the mesh woven includes a mesh yarn of at least 500 denier.

13. The blast shield of claim 9, wherein the mesh woven includes a mesh yarn of at least 1000 denier.

14. The blast shield of claim 9, wherein the mesh woven includes a mesh yarn of at least 1500 denier.

15. The blast shield of claim 9, wherein the mesh woven includes a manufactured fiber such as Vectran that is spun from a liquid crystal polymer.

16. The blast shield of claim 1, wherein the inner layer is made from a material which is self-extinguishing, and does not support flame.

17. The blast shield of claim 1, wherein the blast shield provides V50 penetration resistance of at least 500 fps for ½ inch steel ball bearings.

18. The blast shield of claim 1, wherein the blast shield provides V50 penetration resistance of at least 1000 fps for ½ inch steel ball bearings.

19. The blast shield of claim 1, wherein the outer layer includes HMWPE.

20. The blast shield of claim 1, wherein:

the protective layers are at least approximately round in shape;

the blast shield further includes a plurality of weights suspended from the blast shield by a plurality of cords attached symmetrically about an outer rim of the blast shield; and deployment of the blast shield includes rotation of the blast shield, thereby extending the weights outward by centrifugal force, and extending the shield into an approximately planar, cast-net dynamic whereby a direction of flight of the blast shield toward the suicide bomber suspect is substantially normal to the plane of the blast shield.

21. The blast shield of claim 1, wherein the blast shield includes three inner protective layers and one outer protective layer.

22. The blast shield of claim 1, wherein the blast shield includes two inner protective layers and one outer protective layer.

* * * * *